US005772540A

United States Patent [19]

Kuebler

[11] Patent Number: 5,772,540

[45] Date of Patent: Jun. 30, 1998

[54] RACKET FOR TENNIS OR THE LIKE GAMES

[76] Inventor: Siegfried Kuebler, Mozartstr. 17, D-88662 Überlingen, Germany

[21] Appl. No.: 530,570

[22] Filed: Sep. 20, 1995

[30] Foreign Application Priority Data

Sep. 22, 1994 [DE] Germany ..... 44 33 794.9

[51] Int. Cl.[6] ..... A63B 49/02

[52] U.S. Cl. ..... 473/519; 473/521

[58] Field of Search ..... 473/519, 520, 473/521, 522, 549, 548, 523

[56] References Cited

U.S. PATENT DOCUMENTS

| | | | |
|---|---|---|---|
| 3,075,768 | 1/1963 | Karns | 473/549 |
| 3,330,560 | 7/1967 | Higdon | 473/519 |
| 3,625,512 | 12/1971 | Latham | 473/519 |
| 3,913,911 | 10/1975 | Peterson | 473/519 |
| 4,057,250 | 11/1977 | Kuban | 473/521 |
| 4,153,249 | 5/1979 | Plagenhoef | 473/521 X |
| 4,182,512 | 1/1980 | Kuebler | 473/521 |
| 4,330,125 | 5/1982 | Sassler | 473/521 |
| 4,697,811 | 10/1987 | Muroi | 473/519 |
| 5,098,098 | 3/1992 | Petralia | 473/521 |
| 5,199,706 | 4/1993 | Chen | 473/549 |

*Primary Examiner*—William E. Stoll
*Attorney, Agent, or Firm*—Bachman & LaPointe, P.C.

[57] ABSTRACT

In a racket for tennis or the like games having a frame for receiving stringing, comprising a hollow tube, and a handle end, wherein receiving spaces for granules or the like mass particles are associated with the racket, at least one receiving space (40) is arranged at the outside surface (34) of the tube (14), wherein in particular a recess which is formed in the outside (34) of the profile bar (14) and which is covered over serves as the receiving space.

9 Claims, 1 Drawing Sheet

RACKET FOR TENNIS OR THE LIKE GAMES

BACKGROUND OF THE INVENTION

The invention concerns a racket for tennis or the like games, having a frame for receiving stringing, comprising a hollow profile bar (hollow tube), as well as a handle end, wherein associated with the racket are receiving spaces for granules or the like mass particles of a solid medium. A channel can be formed in the outside of the profile bar tube, bores for the stringing extending from the channel.

Rackets of that kind provide that adaptation to the physical factors of a player is achieved in particular by virtue of the choice of the racket grip in terms of shape and weight. As that method has been found to be difficult and—in particular in regard to stock-keeping—expensive, the applicant of U.S. Pat. No. 4 182 512 sought a way of being able to easily adapt the racket to the strength of the individual player and to increase the internal damping of the racket frame so that as far as possible vibrations are already brought under control at the place at which they are generated.

The construction in that prior invention provided arranging on the racket or in its parts a box-like receptacle in which a granule-like medium —preferably of high specific weight such as buckshot—is disposed with play, the granule-like medium being movable limitedly at least transversely to the axis of the racket. This addition of granule-like medium permits the racket to be adapted to the wishes of the individual player. In addition, the change in the conditions in respect of energy on a moving racket, due to additional weighting particles which move in a relatively differentiated fashion, results in a considerably better hitting procedure and performance; in comparison with a conventional racket, with the force applied being the same, the weight of hitting is considerably increased, and the thrust force of an impinging ball on the racket is greatly braked without a large amount of force being applied.

Cartridges or similar receptacles are proposed in accordance with U.S. Pat. No. 4 182 512 for the granule-like medium on the racket frame, or the per se known heart portion of the racket is of a hollow construction and filled with the granule-like medium. In accordance with a further design which is discussed therein, the profile or hollow space of a hollow tube is subdivided by partitioning walls into a plurality of granule-filled chambers. The profile space is divided in that way for example by a strip which can be inserted into the profile space and which carries transverse plate portions or transverse wall portions which fill up the cross-section of the profile space.

The introduction of granular, dry and pourable layers comprising sand or steel or lead balls or shot into the hollow tube in the case of metal rackets, into holes which are drilled into the frame or into attached cartridges, provides a considerable wide-band damping effect which is at its highest when the grains are disposed at the location involving the greatest movement, that is to say at both sides of the hitting surface.

An arrangement in individual juxtaposed chambers enhances the effect. The non-linearity of the damping effect is among the substantial advantages of the damping mechanism if the acceleration due to gravity is overcome, as when a ball is hit. More specifically, the damping effect is available precisely when it is needed, at large amplitudes or high levels of acceleration.

SUMMARY OF THE INVENTION

With knowledge of that state of the art, the inventor set himself the aim of permitting simple application of the granule-like medium, in particular in relation to lightweight frames of plastic material with fiber windings.

That object is attained by the teaching of the independent claim; the appendant claims set forth advantageous embodiments.

In accordance with the invention at least one receiving space for the mass particles is arranged at the outside surface of the hollow tube, preferably at least one inwardly shaped recess which is shaped in the outside of the hollow tube and which is covered over, or a protective strip which lies on the outside of the hollow tube and which contains the receiving space or spaces.

In accordance with a further feature of the invention the outside of the hollow tube on the one hand and a protective strip of different curvature, which lies on the hollow tube, on the other hand, define a hollow space for the granule-like medium.

The granules can also be disposed in a tube-like sheath and the latter an be fitted into the receiving space.

In the case of a hollow tube having a channel which is formed in its outside and from which extend bores for the strings, the receiving spaces are preferably to be arranged on both sides of the channel.

An addition in regard to the adjustable arrangement of additional granules can provide that receiving spaces for the granules are also provided at the sides of the handle.

BRIEF DESCRIPTION OF THE DRAWINGS

Further advantages, features and details of the invention will be apparent from the following description of preferred embodiments and with reference to the drawing in which.

DETAILED DESCRIPTION

Figure 1:
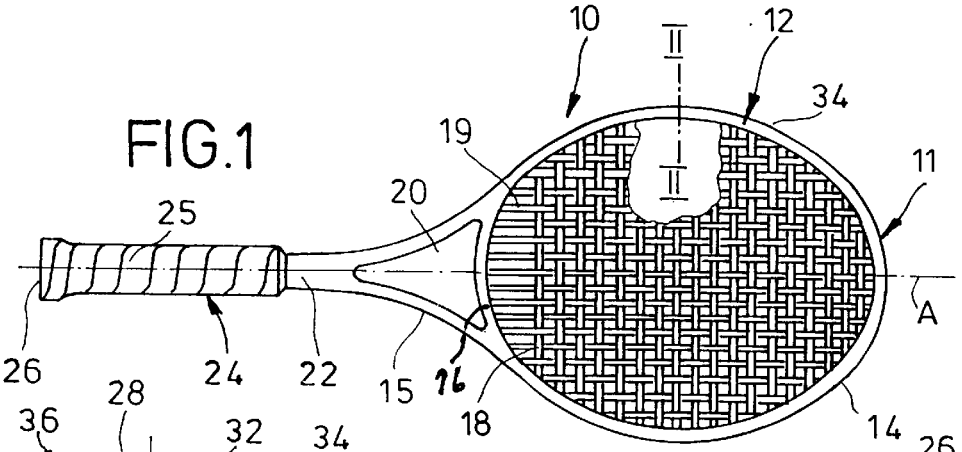
FIG. 1 is a plan view of a tennis racket with frame, heart zone and handle.

A tennis racket 10 has a frame 12 comprising a hollow tube 14 which is bent approximately to an oval shape, and a frame crosspiece 16 which completes that oval; arranged in the oval of the frame 12 is stringing comprising mutually crossing transverse and longitudinal strings 18 and 19 which pass through the frame 12 and the frame crosspiece 16. Outside the frame 12 the two end portions 15 of the hollow tube 14 laterally define a free area 20, which is triangular in plan view, of a heart zone which has each end portion 15 and the frame crosspiece 16. At the ends thereof which are remote from the frame, on the axis A of the racket, the end portions 15 merge into a handle neck 22 which is adjoined by a handle 24 with a handle tape winding 25 that covers over a handle cap 26.

Figure 2:
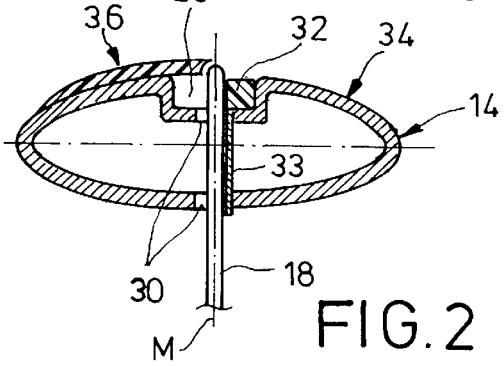
FIG. 2 is a view on an enlarged scale in cross-section taken along line II—II in FIG. 1 through a hollow tube forming the frame of the tennis racket.

As shown in the sectional view in FIG. 2, the hollow tube 14 is of a somewhat extended oval cross-section with slightly curved wall cross-sections and a channel 28 formed therein on its outside, bores 30 extending from the channel 28 for strings to pass therethrough. A plastic strip of which part is indicated at 32 rests in the channel 28, as an eye band with tube portions 33 which are formed thereon in approximately mutually parallel relationship; the tubes 33 pass through the bores 30 as grommets to protect the strings 18, 19.

The center line M of the bores 30 is at the same time the axis of symmetry of the cross-section of the hollow tube.

Extending on the outside surface of the hollow tube 14 in the region of the racket head 11 is a head band of plastic material which extends over the channel 28, as a protective strip 36 which fits closely to that outside surface 34.

Figure 3:
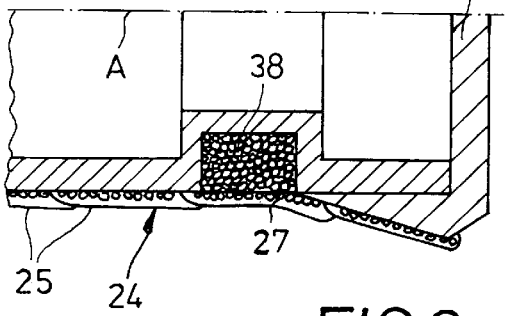
FIG. 3 is a partial view on an enlarged scale in cross-section through the free end of the handle.

FIG. 3 shows that a receiving space 27 for a granule material which is only partially indicated at 38 is formed into the profile of the handle 24 at the handle cap 26. The granule material can be determined in respect of its weight and makes it possible to alter the weight distribution in the tennis racket 10 and thus the so-called sweet spot thereof, in accordance with the wishes of the player. The receiving space 27 is closed outwardly by the handle tape winding 25. It is indicated in regard to the latter that, with the outside surface of the handle 24, it can hold particles 38 of granule material, as will be described hereinafter in respect of the protective strip 36.

Figure 4:
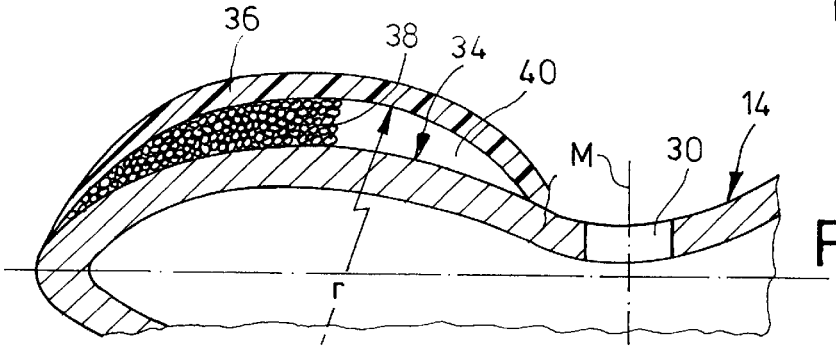
FIGS. 4, 5, and 6 are partial views in cross-section through hollow tubes of different configurations with a protective strip lying thereon.

A hollow space or cavity 40 which is of a half-moon configuration in cross-section and which accommodates the granules 38 is provided between the outside surface 34 of the hollow tube and the protective strip 36 whose cross-sectional radius of curvature r in FIG. 4 is selected to be relatively short relative to that of the outside surface 34. The granules 38 can be disposed directly in the space 40 or disposed therein in a tube-like sheath 42, as is shown in FIG. 6 in relation to another embodiment.

Figure 5:
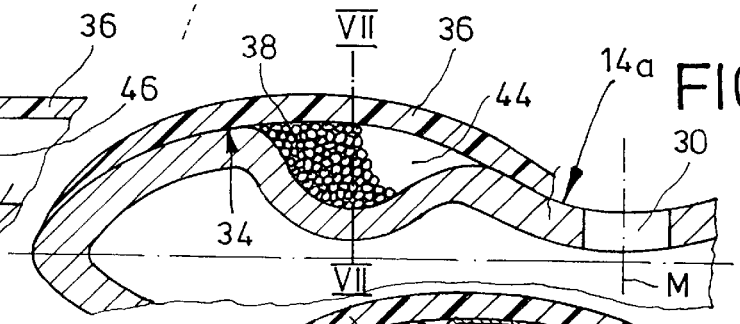
Figure 6:
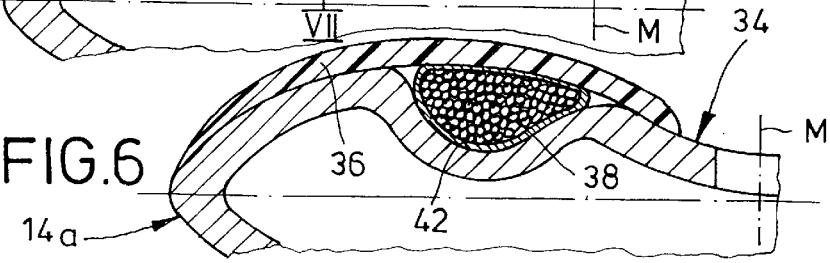

The hollow tube 14, in FIG. 5 contains a groove-like longitudinal recess 44 formed therein for receiving the granules 38 with or without a sheath 42 (FIG. 6).

The drawing does not show that the granule deposits 40, 42, 44 can be provided only on one side of the center line M or —symmetrically—on both sides or can be arranged within the protective strip 36 itself.

Figure 7:
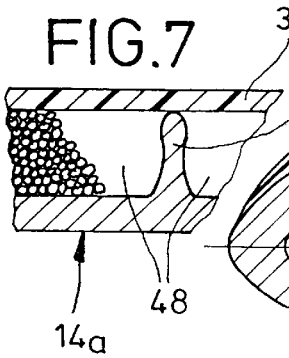
FIG. 7 is the view through FIG. 5 taken along line VII—VII.

The drawing also does not show that the space 40 or the longitudinal recess 44 can also be provided at a plurality of locations in each half of the cross-section of the hollow tube. FIG. 7 shows that the space 40 or the longitudinal recess 44 can be divided into a plurality of chambers 48 by dividing walls 46.

I claim:

1. A racket comprising a frame for accommodating stringing, said frame having a hollow tube and a handle end, said hollow tube having an outside surface, said outside surface having formed thereon means for receiving a granular mass for altering weight distribution of the racket, a granular mass located in said receiving means and a covering means extending over said receiving means for retaining the granular mass within said receiving means.

2. A racket according to claim 1 wherein said covering means includes strip means secured to said outside surface for covering said receiving means and enclosing said granular mass within said receiving means.

3. A racket according to claim 2 wherein said hollow tube includes a head portion and said receiving means is formed on said head portion.

4. A racket according to claim 2 wherein said mass is provided in a sheath and the sheath is located in said receiving means.

5. A racket according to claim 1 wherein recess means for receiving mass is formed in the handle.

6. A racket according to claim 1 wherein the covering means has a radius of curvature (r) and the hollow tube has a radius of curvature wherein (r) is shorter than the radius of curvature of the hollow tube.

7. A racket according to claim 1 wherein a further granular mass is provided on tape on the handle end.

8. A racket according to claim 1 wherein said receiving means is subdivided into chambers by wall means.

9. A racket according to claim 1 wherein said hollow tube is provided with bore means for accommodating stringing and said receiving means are arranged on both sides of the bore means.

* * * * *